US008661958B2

(12) United States Patent
Chizek

(10) Patent No.: US 8,661,958 B2
(45) Date of Patent: Mar. 4, 2014

(54) DEVICE FOR MANUALLY PERFORATING A SHEET OF ALUMINUM FOIL AND A METHOD OF USE

(76) Inventor: Michael Arthur Chizek, Two Rivers, WI (US)

( * ) Notice: Subject to any disclaimer, the term of this patent is extended or adjusted under 35 U.S.C. 154(b) by 0 days.

(21) Appl. No.: 13/313,575

(22) Filed: Dec. 7, 2011

(65) Prior Publication Data

US 2012/0111164 A1 May 10, 2012

Related U.S. Application Data

(62) Division of application No. 12/221,400, filed on Aug. 1, 2008, now Pat. No. 8,104,390.

(51) Int. Cl.
*B26D 3/08* (2006.01)

(52) U.S. Cl.
USPC ..... 83/660; 83/697

(58) Field of Classification Search
USPC ..... 83/660, 686, 691, 687
See application file for complete search history.

(56) References Cited

U.S. PATENT DOCUMENTS

| | | | | |
|---|---|---|---|---|
| 1,762,219 | A | 6/1930 | Faber | |
| 2,925,207 | A | 2/1960 | Kunsch | |
| 3,088,640 | A | 5/1963 | Kunsch | |
| 3,520,220 | A | 7/1970 | Acker | |
| 3,830,151 | A * | 8/1974 | Gerson | 99/537 |
| 3,964,354 | A | 6/1976 | Johannsen | |
| 3,967,336 | A | 7/1976 | Cutter | |
| 4,009,811 | A | 3/1977 | Takai | |
| 4,060,366 | A | 11/1977 | Johansson | |
| D250,632 | S | 12/1978 | Takai | |
| 4,137,807 | A | 2/1979 | Schaumberg | |
| 4,436,025 | A * | 3/1984 | Jones | 99/538 |
| 4,442,740 | A | 4/1984 | Rayton | |
| 4,462,288 | A | 7/1984 | Boyce | |
| 4,706,533 | A | 11/1987 | Giulie | |
| 5,121,679 | A * | 6/1992 | Mertz | 99/538 |
| 5,337,480 | A * | 8/1994 | Codikow | 30/114 |
| 6,123,972 | A | 9/2000 | Matthews et al. | |
| 6,596,329 | B1 * | 7/2003 | D'Ambro et al. | 426/484 |
| 8,104,390 | B2 | 1/2012 | Chizek | |
| 2003/0005802 | A1 * | 1/2003 | Kyono et al. | 83/531 |

* cited by examiner

*Primary Examiner* — Kenneth E. Peterson
(74) *Attorney, Agent, or Firm* — Thomas J. Connelly; Wilhelm Law, S.C.

(57) ABSTRACT

A device and a method are disclosed for manually perforating a sheet of aluminum foil. The device includes a first member having a first surface with a plurality of apertures formed therein and a first guide member extending upwardly above the first surface. The device also includes a second member having a lower surface with a plurality of projections extending downwardly therefrom. Each of the projections can be simultaneously inserted into one of the plurality of apertures. A second guide member is formed on the second member and cooperates with the first guide member to permit the second member to move vertically relative to the first member. A sheet of aluminum foil can be placed between the first and second members, when they are spaced apart from one another, and the sheet of aluminum foil can be perforated by pressing the second member against the first member.

18 Claims, 11 Drawing Sheets

A METHOD OF MANUALLY PERFORATING A SHEET OF ALUMINUM FOIL, COMPRISING THE STEPS OF:

PLACING A NON-PERFORATED SHEET OF ALUMINUM FOIL BETWEEN A FIRST SURFACE OF A FIRST MEMBER WHICH IS SPACED APART FROM A LOWER SURFACE OF A SECOND MEMBER, SAID FIRST SURFACE HAVING A PLURALITY OF APERTURES FORMED THEREIN, SAID SECOND MEMBER HAVING AN UPPER SURFACE AND AT LEAST A PORTION OF SAID UPPER SURFACE IS ERGONOMICALLY SCULPTURED TO FIT A HUMAN HAND AND SAID LOWER SURFACE HAVING A PLURALITY OF PROJECTIONS EXTENDING DOWNWARDLY THEREFROM, EACH OF SAID PROJECTIONS BEING SIZED AND CONFIGURED TO BE SIMULTANEOUSLY INSERTED INTO ONE OF SAID PLURALITY OF APERTURES, AND EACH OF SAID PROJECTIONS HAVING A SHARP TERMINAL END, A FIRST GUIDE MEMBER FORMED ON SAID FIRST MEMBER AND A SECOND GUIDE MEMBER FORMED ON SAID SECOND MEMBER, SAID SECOND GUIDE MEMBER BEING SIZED AND CONFIGURED TO COOPERATE WITH SAID FIRST GUIDE MEMBER TO PERMIT SAID SECOND MEMBER TO MOVE VERTICALLY RELATIVE TO SAID FIRST MEMBER;

MANUALLY PRESSING SAID SECOND MEMBER AGAINST SAID FIRST MEMBER TO CAUSE SAID PLURALITY OF PROJECTIONS TO PENETRATE THROUGH SAID SHEET OF ALUMINUM FOIL AND FORM A PLURALITY OF PERFORATIONS IN SAID SHEET OF ALUMINUM FOIL;

MOVING SAID LOWER SURFACE VERTICALLY AWAY FROM SAID FIRST SURFACE SUCH THAT SAID PLURALITY OF PROJECTIONS ARE SPACED APART FROM SAID FIRST SURFACE AND FROM SAID PLURALITY OF PERFORATIONS FORMED IN SAID SHEET OF ALUMINUM FOIL; AND

REMOVING SAID PERFORATED SHEET OF ALUMINUM FOIL FROM BETWEEN SAID FIRST AND SECOND MEMBERS.

FIG. 23

DEVICE FOR MANUALLY PERFORATING A SHEET OF ALUMINUM FOIL AND A METHOD OF USE

CROSS REFERENCE TO RELATED APPLICATIONS

This application is a Divisional of application Ser. No. 12/221,400, filed Aug. 01, 2008, now U.S. Pat. No. 8,104, 390, which is incorporated herein by reference in its entireties.

FIELD OF THE INVENTION

This invention relates to a device for manually perforating a sheet of aluminum foil and a method of use.

BACKGROUND OF THE INVENTION

Today, it is very popular to cook food on an outdoor grill using wood chips, charcoal briquettes or propane gas. When certain woodchips, such as cherry and hickory, are used, the food being grilled tends to pick up the flavor of the wood chips and this causes the food to taste much better. The same is believed to be true when using charcoal briquettes.

It is also advantageous to grill certain foods outdoors so as to eliminate foul odors from permeating a kitchen and/or adjacent rooms. This is especially true when one wishes to cook certain kinds of fish. Fish odors tend to linger for twelve or more hours. Generally, a greater amount of odors are emitted when the fish contains a high amount of oil, such as salmon. Many people cannot tolerate fish odors in their house.

It has also become common practice for many people to support, enclose and/or wrap different kinds of meat, fish, poultry, and even some vegetables, such as ears of corn, on or in a sheet of aluminum foil. By placing a sheet of aluminum foil under a food item or around a food item, one can eliminate the need to clean the grill the next time they wish to grill food. In addition, by placing a sheet of aluminum foil under a delicate food item, such as a piece of fish, one can prevent the food item from falling down between the grates while it is being grilled. Furthermore, a sheet of aluminum foil placed under a piece of fish, which still has its skin attached, will prevent the skin from adhering to the grates during the grilling process. If the aluminum foil is not present, the skin will stick to the grates. When one attempts to remove the fish from the grill, the meaty flesh of the fish can separate from the skin and may fall between the grates. In addition, when a piece of fish is grilled on a sheet of aluminum foil, the intact piece of fish can be easily removed from the grill by transferring the sheet of aluminum foil and its contents onto a serving tray.

Non-perforated aluminum foil is typically wound up into rolls on a hollow cardboard tube which has a diameter of from between about 1 inch to about 3 inches. The width of the aluminum foil can vary but generally ranges from between about 12 inches to about 24 inches. Such rolls of aluminum foil are commonly sold in many stores, including grocery and mass merchandise stores, and are packaged in an elongated cardboard box having a sharp corrugated edge. The sharp corrugated edge allows a consumer to withdraw a predetermined length of aluminum foil and separate it from the remainder of the roll. This feature permits a consumer to vary the length of the sheet of aluminum foil needed to suit a particular purpose.

When one desires to grill certain food, especially juicy fish, one may take a fork, a knife, or some other sharp object and poke one or more apertures, holes or openings through the sheet of aluminum foil to allow the juices and other residue from the fish to drain away from the fleshy meat while it is being grilled. The openings formed in the sheet of aluminum foil can also decrease the amount of time needed to grill the piece of fish or other food item by allowing heated air to circulate entirely around food item while it is being cooked.

There are several drawbacks with using a fork, a knife or some other sharp object to perforate a sheet of aluminum foil. First, it is dangerous to perforate a sheet of aluminum foil by stabbing the sheet with a sharp object. One could easily puncture and/or cut his or her hand by doing so. Second, many small pieces of the aluminum foil can be left behind that may be hard to clean up or which can adhere themselves to the food item. If tiny bits of aluminum foil become embedded in the food item and the food is eaten, it could cause serious health problems. Third, one could rip or tear a large opening in the sheet of aluminum foil and render it un-useable such that it has to be thrown away. In this case, another sheet of aluminum foil will have to be cut from the aluminum roll resulting in excess aluminum foil being used. Lastly, it is very time consuming to punch multiple openings in each sheet of aluminum foil that is required. Normally, several food items are being grilled at one time in order to feed two or more people.

Now, a device for manually perforating a sheet of aluminum foil in a safe and efficient manner has been invented which is reasonably priced, easy to manufacture, takes up little space in a kitchen drawer, and is simple to operate. The method of perforating a sheet of aluminum foil is also taught.

SUMMARY OF THE INVENTION

Briefly, this invention relates to a device and method for manually perforating a sheet of aluminum foil. The device includes a first member having a first surface with a plurality of apertures formed therein. A first guide member is formed on the first member and extends upwardly above the first surface. The device also includes a second member having an upper surface and a lower surface. At least a portion of the upper surface is ergonomically sculptured to fit a human hand. The lower surface of the second member has a plurality of projections extending downwardly therefrom. Each of the plurality of projections is sized and configured to be simultaneously inserted into one of the plurality of apertures, and each of the projections has a sharp terminal end. A second guide member is formed on the second member. The second guide member is sized and configured to cooperate with the first guide member to permit the second member to move vertically up and down relative to the first member. A sheet of aluminum foil can be placed between the first and second members, when they are spaced apart from one another, and the sheet of aluminum foil can be perforated by pressing the second member against the first member.

The general object of this invention is to provide a device and method for manually perforating a sheet of aluminum foil. A more specific object of this invention is to provide a compact, light weight device that can be operated with one hand to perforate a sheet of aluminum foil.

Another object of this invention is to provide a device and method for manually perforating a sheet of aluminum foil that can be operated with either a person's right hand or left hand.

A further object of this invention is to provide a portable device for manually perforating a sheet of aluminum foil which can be easily stored in a kitchen drawer.

Still another object of this invention is to provide an inexpensively priced device and a simple method for manually perforating a sheet of aluminum foil which can be constructed from a material that is dishwasher safe.

Still further, an object of this invention is to provide a device and method for manually perforating a sheet of aluminum foil which contains an ergonomically sculptured upper surface which can be easily grasped and will fit different size hands.

Other objects and advantages of the present invention will become more apparent to those skilled in the art in view of the following description and the accompanying drawings.

BRIEF DESCRIPTION OF THE DRAWINGS

FIG. 23 is a flow diagram of a method of manually perforating a sheet of aluminum foil.

DETAILED DESCRIPTION OF THE INVENTION

Figure 8:
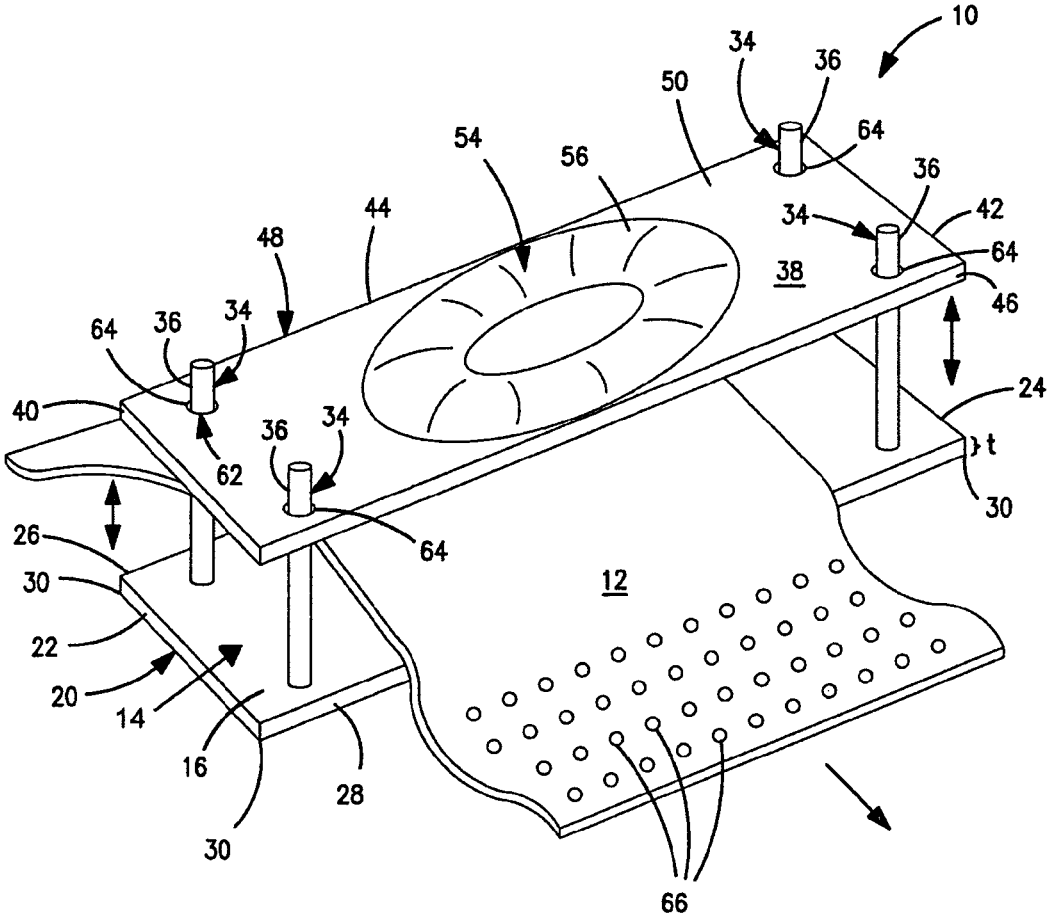
FIG. 8 is a perspective view of the device shown in FIGS. 1-6 depicting a sheet of aluminum foil positioned between the spaced apart first and second members and depicting the leading edge of the sheet of aluminum foil already having been perforated.

Referring to FIG. 8, a device 10 is shown which is capable of manually perforating a non-perforated sheet of aluminum foil 12. By "aluminum" it is meant a silvery-white, ductile metallic element, found chiefly in bauxite having an atomic number 13, an atomic weight of 26.98, and a melting point of 660.2° C. Even though this invention will be explained with reference to a sheet of aluminum foil 12, it is to be understood that other materials, including but not limited to: ferrous and non-ferrous materials, tin, titanium, magnesium, manganese, molybdenum, chromium, copper, nickel, gallium, a corrosion-resistant metal or alloy, stainless steel, a composite material containing two or more different metals or alloys, etc. can also be perforated using the device 10.

Referring to FIGS. 1-6 and 8, the device 10 includes a first member 14 having a first surface 16 and an oppositely aligned second surface 18. The first member 14 has a length l and a width w, see FIG. 1. The length l and the width w can vary. For example, the length can range from between about 6 inches to about 16 inches and the width w can range from between about 2 inches to about 4 inches. The first member 14 also has a thickness t, see FIG. 2, which represents the distance located between the first and second surfaces, 16 and 18 respectively. The thickness t can vary. For example, the thickness t can range from between about 0.125 inches to about 1 inch. The first member 14 also has an outer periphery 20, see FIGS. 1, 3 and 8. The outer periphery 20 can be of any desired geometrical shape including but not limited to: a square, a rectangular, a triangle, a circle, an oval, an ellipse, or an irregular configuration. The outer periphery 20 can also be of a desired shape, such as a rectangle having one or more indentation or finger and thumb openings or configurations formed therein.

Figure 1:
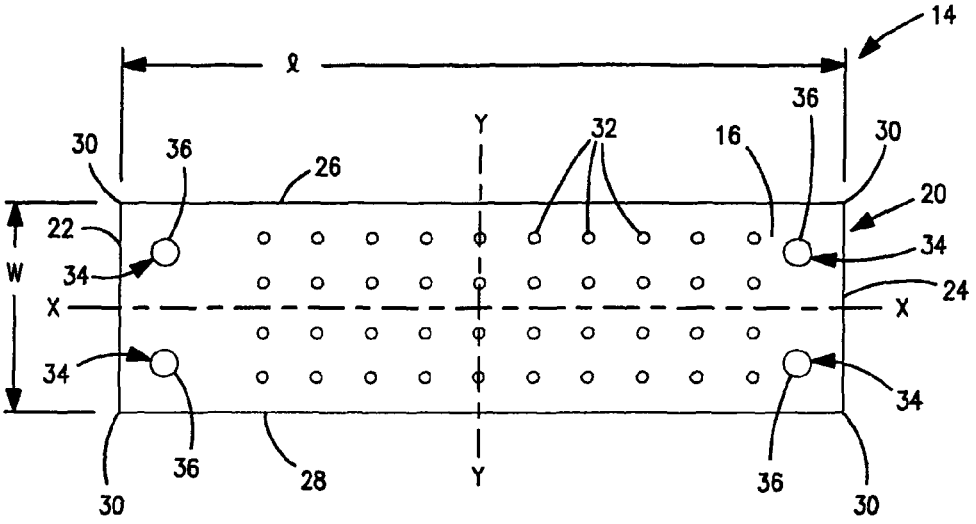
FIG. 1 is a top view of a first member of the device for manually perforating a sheet of aluminum foil depicting a plurality of apertures formed therein in a pre-selected pattern.

In FIG. 1, the first member 14 is shown as a rectangle having a first end 22, an oppositely aligned second end 24, a first side 26 and an oppositely aligned second side 28. The first and second ends, 22 and 24 respectively, are aligned perpendicular to the first and second sides, 26 and 28 respectively. The first member 14 has a longitudinal central axis X-X, a transverse central axis Y-Y and a vertical central axis Z-Z. Four corners 30, 30, 30 and 30 are located at the intersections of each of the first and second ends, 22 and 24 respectively, with the first and second sides, 26 and 28 respectively.

The first member 14 can be constructed or formed from various materials, including but not limited to: plastic, thermoplastic, metal, a metal that has been coated or plated, an alloy, a coated alloy, a composite material, aluminum, stainless steel, wood, etc. For example, a ferrous material can be coated or plated with another material, such as chrome, to make it rust resistance or dishwasher safe. Desirably, the first member 14 is constructed or formed from a material that is dishwasher safe. By "dishwasher safe" it is meant a material that can be repeatedly subjected to washing at a temperature of at least 100° F. for at least 10 minute intervals. The first member 14 should be capable of being washed in a dishwasher many times without deteriorating to a condition where it is incapable of functioning for its intended purpose.

Figure 2:
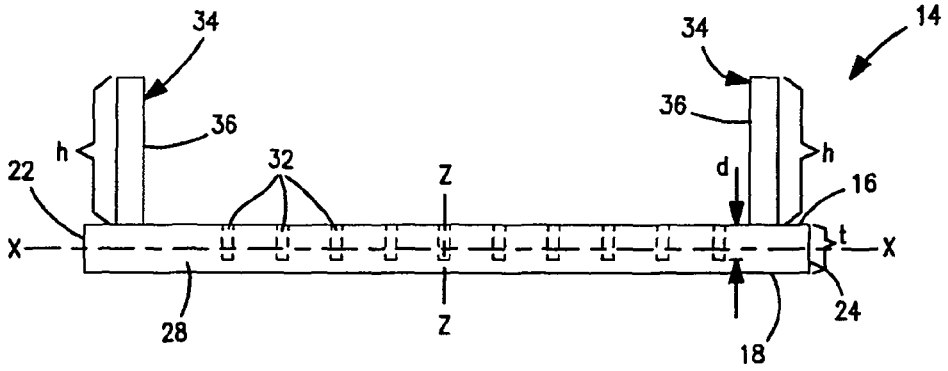
FIG. 2 is a side view of first member shown in FIG. 1 depicting a first guide member and showing that the plurality of apertures extend into but not completely through the thickness of the first member.

Referring to FIGS. 1-2, the first surface 16 of the first member 14 has a plurality of apertures 32 formed therein. The plurality of apertures 32 can be arranged in any desired preselected pattern or in a non-regular pattern. One example is the rectangular pattern shown in FIG. 1 which consists of four rows, each containing ten apertures 32. Each row of apertures 32 is aligned parallel to the longitudinal central axis X-X. It should be understood that a pattern can consist of randomly or symmetrically arranged apertures 32. The apertures 32 can be arranged in a linear fashion or in a non-linear fashion, for example in a circle. The size of the apertures 32 can vary. Desirably, all the apertures 32 are of the same size and configuration. Alternatively, one or more of the apertures 32 can vary in size and/or shape from another aperture 32.

Referring to FIG. 2, each of the plurality of apertures 32 has a depth d which can be equal to or be less than the thickness t of the first member 14. Desirably, the depth d of each of the apertures 32 is less than the thickness t of the first member 14. The depth d of one of the apertures 32 can be the same or be different from the depth d of another aperture 32. In other words, various apertures 32 can be formed to different depths d. Desirably, each of the plurality of apertures 32 has a depth d which is at least about 75% of the thickness t of the first member 14. More desirably, each of the plurality of apertures 32 has a depth d which is at least about 50% of the thickness t of the first member 14. Even more desirably, each of the plurality of apertures 32 has a depth d which is at least about 40% of the thickness t of the first member 14. Most desirably, each of the plurality of apertures 32 has a depth d which is at least about 25% of the thickness t of the first member 14.

Each of the plurality of apertures 32 should be spaced apart from an adjacent aperture 32. Each of the plurality of apertures 32 can vary in size, shape and configuration. All the apertures 32 do not have to have the same size, shape and/or configuration. Each of the plurality of apertures 32 can vary in cross-sectional shape. For example, one or more of the apertures 32 can be circular in cross-section, be square in cross-section, be rectangular in cross-section, be triangular in cross-section, be oval in cross-section or have any other desired cross-sectional configuration. The plurality of apertures 32 can have parallel side walls, tapered sidewalls or irregular shaped sidewalls. In FIG. 2, the plurality of apertures 32 are cylindrical in shape and each has sidewalls which are aligned parallel to an opposite sidewall.

Still referring to FIGS. 1-3 and 8, the first member 14 has a first guide member 34 formed therein or thereon. Desirably, the first guide member 34 extends upwardly from the first surface 16. The first guide member 34 can be integrally formed from the first member 14 or be a separate member that is secured, attached or fastened thereto by various means known to those skilled in the art. In FIGS. 1 and 2, the first guide member 34 includes four guide segments 36 each in the shape of an elongated cylindrical post. It should be noted that a single guide segment 36 could be utilized, if desired. Desirably, at least two guide segments 36 are present, one being located adjacent to the first and second ends, 22 and 24 respectively, of the first member 14. More desirably, four guide segments 36 are present with two being positioned adjacent to the first end 22 and two being positioned adjacent to the second end 24. Each of the guide segments 36 should be spaced apart from one another.

Referring again to FIG. 2, each of the guide segments 36 has a height h which extends above the first surface 16. This height h dimension can be less than the total length of a guide segment 36 because part of each guide segment 36 may be inserted into an aperture (not shown) formed in the first member 14. The height h of each of the guide segments 36 can vary. Desirably, each guide segment 36 will have a height h which ranges from between about 0.5 inches and about 3 inches. More desirably, each guide segment 36 will have a height h which ranges from between about 0.75 inch and about 2.5 inches. Even more desirably, each guide segment 36 will have a height h which ranges from between about 1 inch and about 2 inches. Most desirably, each guide segment 36 will have a height h which is at least about 1.25 inches.

Each guide member 34 can be constructed or formed from the same material as was used to construct or form the first member 14. Alternatively, each guide member 34 can be constructed or formed from a different material than that used to construct or form the first member 14.

Figure 3:
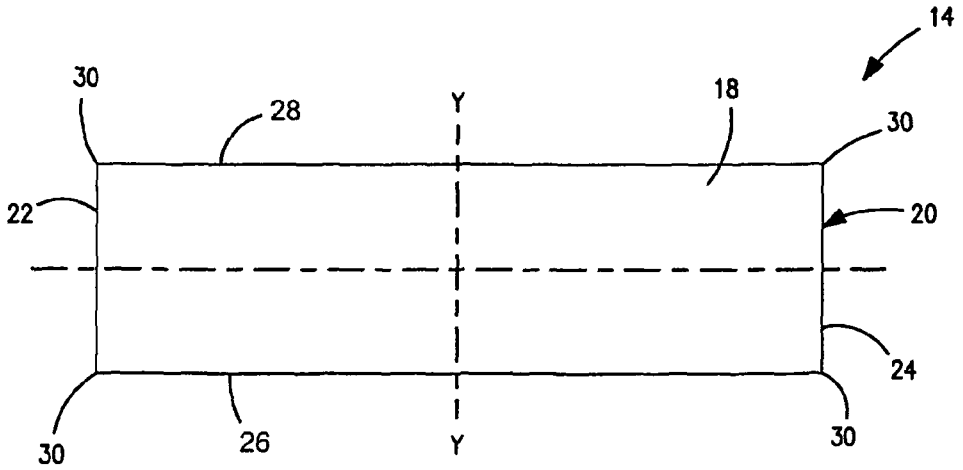
FIG. 3 is a bottom view of the first member shown in FIG. 1.

Referring to FIG. 3, one will notice that the second or bottom surface 18 of the first member 14 is relatively flat so that it can be securely placed on a flat surface such as a counter top, table, etc. No apertures or openings are visually present in the second or bottom surface 18 of the device 10 when the depth d of each of the apertures 32 is less than the thickness t of the first member 14. Alternatively, if the apertures 32 extend completely through the thickness t of the first member 14, then they will be visible in the bottom surface 18. Optionally, the second or bottom surface 18 can be scored, machined, treated, coated or have a material adhered to it to give it a high coefficient of friction such that it will not easily slide or move relative to an adjacent surface. By a high coefficient of friction it is meant a value equal to or exceeding 0.5. For example, a soft rubber layer can be added to the second or bottom surface 18 so that it is more likely to remain stationary during use.

Referring to FIGS. 4-8, the device 10 also includes a second member 38. The second member 38 can be formed or constructed from the same material as was used to form or construct the first member 14. Alternatively, the second member 38 can be formed or constructed from a different material. The second member 38 has a length $l_1$ and a width $w_1$, see FIG. 4. The length $l_1$ and the width $w_1$ can vary. For example, the length $l_1$ and the width $w_1$ of the second member 38 can be less than, equal to or greater than the length l and width w of the first member 14. Desirably, the first and second members, 14 and 38 respectively, have the same or essentially the same length, l and $l_1$, and width, w and $w_1$. The second member 38 also has a thickness $t_1$ and a thickness $t_2$, see FIG. 5. The thickness $t_1$ is the overall thickness of the second member 38. The thickness $t_2$ is a portion of the overall thickness $t_1$ of the second member 38. The second member 38 has a first end 40, an oppositely aligned second end 42, a first side 44, and an oppositely aligned second side 46. The second member 38 also has an outer periphery 48 which is contiguous with the outer periphery 20 of the first member 14. Alternatively, the outer periphery 48 of the second member 38 can be larger or smaller than the outer surface 20 of the first member 14.

Figure 5:
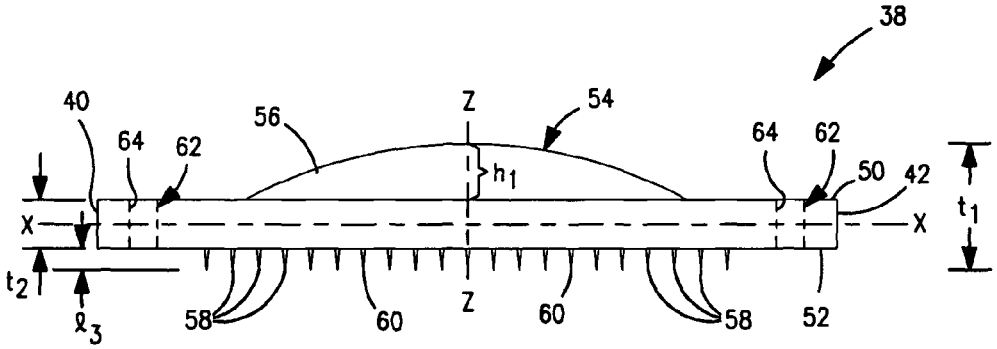
FIG. 5 is a side view of the second member shown in FIG. 1 depicting a plurality of downwardly extending projections.
Figure 6:
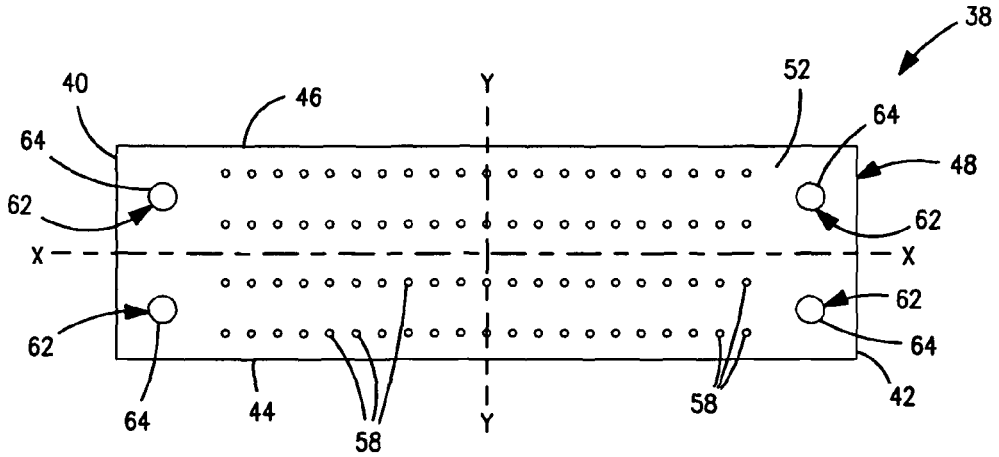
FIG. 6 is a bottom view of the second member shown in FIG. 1 depicting the plurality of downwardly extending projections arranged in a pre-selected pattern.

Referring to FIG. 5, the second member 38 also has an upper surface 50 and a lower surface 52. The thickness $t_2$ is the smallest distance between the upper and lower surfaces, 50 and 52 respectively. At least a portion of the upper surface 50 can be ergonomically sculptured at 54 to fit or receive a human hand or the fingers and/or thumb of a human hand. In FIG. 5, one embodiment of the ergonomically sculptured portion 54 is shown which extends between the first and second sides, 44 and 46 respectively, and extends over at least about 20% of the dimension between the first and second ends, 40 and 42 respectively. In one embodiment, the ergonomically sculptured portion 54 is shaped similar to an optical mouse, commonly used with a computer. Alternatively, the ergonomically sculptured portion 54 can be relatively flat but include one or more finger and/or thumb cutouts into which the fingers and/or thumb of the user hand can engage with.

In FIG. 5, the ergonomically sculptured portion 54 is depicted as having a convex region 56 which is contoured to allow either a person's left hand or right hand to comfortably grasp it. Alternatively, the ergonomically sculptured portion 54 can be contoured such that it will only conform to the right hand or to the left hand of a person. Desirably, the ergonomically sculptured portion 54 will accommodate both the right and left hand of a person. The ergonomically sculptured portion 54 can also include indentations, grooves or cutouts into which the fingers and/or thumb of a person's hand can comfortably fit.

It should be understood that the ergonomically sculptured portion 54 can vary in height, size, shape and configuration and that several different size devices 10 can be manufactured such that some will accommodate a smaller size hand, such as a female hand, and others can be made larger to accommodate a larger size hand, such as a male hand.

The ergonomically sculptured portion 54 should extend over or be present in at least 20% of the upper surface 50 of the second member 38. Desirably, the ergonomically sculptured portion 54 will extend over or be present in at least 50% of the upper surface 50 of the second member 38. More desirably, the ergonomically sculptured portion 54 will extend over or be present in at least 60% of the upper surface 50 of the second member 38. More desirably, the ergonomically sculptured portion 54 will extend over or be present in at least 75% the upper surface 50 of the second member 38. Even more desirably, the ergonomically sculptured portion 54 will extend over at least 80% the upper surface 50 of the second member 38. Most desirably, the ergonomically sculptured portion 54 will extend over or be present in the entire upper surface 50 of the second member 38.

It should also be understood that the ergonomically sculptured portion 54 could be formed on the first member 14 instead of the second member 38, if desired.

Figure 4:
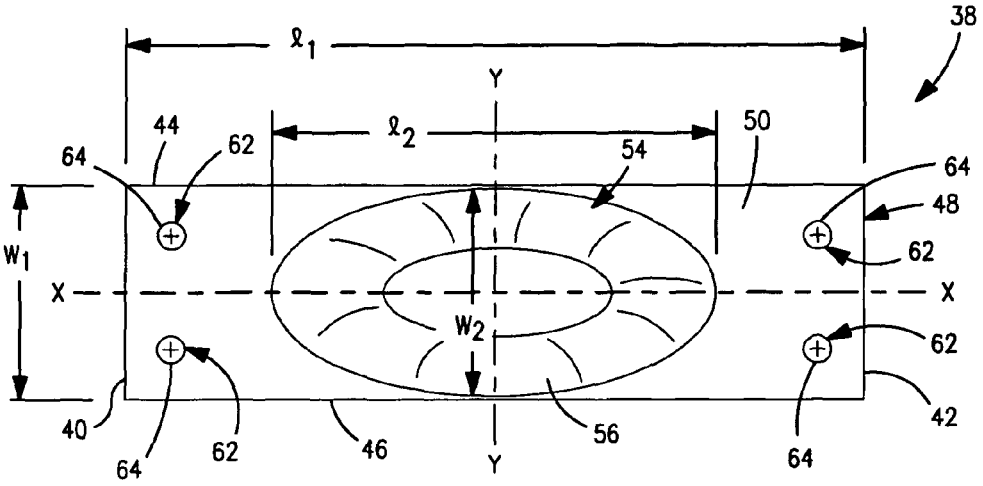
FIG. 4 is a top view of a second member of the device for manually perforating a sheet of aluminum foil and depicts at least a portion of the upper surface being ergonomically sculptured to fit a human hand.

Referring to FIGS. 4 and 5, the exact size, shape, configuration, height, length and width of the ergonomically sculptured portion 54 can vary. As best shown in FIG. 4, the ergonomically sculptured portion 54 has a length $l_2$ and a width $w_2$. The length $l_2$ can range from between about 4 inches to the total length $l_1$ of the second member 38. Desirably, the length $l_2$ of the ergonomically sculptured portion 54 can range from between about 4 inches to about 8 inches. The width $w_2$ of the ergonomically sculptured portion 54 can be less than or be equal to the width $w_1$ of the second member 38. Desirably, the width $w_2$ of the ergonomically sculptured portion 54 is slightly less than the distance between the first and second sides, 44 and 46 respectively. Alternatively, the width $w_2$ of the ergonomically sculptured portion 54 is approximately equal to the distance between the first and second sides, 44 and 46 respectively.

Referring to FIG. 5, this embodiment of the ergonomically sculptured portion 54 has a height $h_1$ that will range from between about 0.5 inches to about 3 inches. Desirably, the height $h_1$ of the ergonomically sculptured portion 54 will range from between about 1 inch to about 2 inches. More desirably, the height $h_1$ of the ergonomically sculptured portion 54 will range from between about 1 inch to about 1.5 inches. Even more desirably, the height $h_1$ of the ergonomically sculptured portion 54 will range from between about 1 inch to about 1.25 inches.

It should be understood that the ergonomically sculptured portion 54 can be relatively flat, having no height $h_1$, if desired. However, in this case, the ergonomically sculptured portion 54 will include finger cutouts and/or a thumb cutout. One or more finger cutouts can be formed or located in the first side 44 and the thumb cutout and/or one or more finger cutouts can be formed or located in the second side 46. The thumb cutout can vary in size and shape relative to the finger cutouts. In some instances, the finger cutouts and the thumb cutout can be formed to have the same size and shape.

Referring to FIG. 5, the lower surface 52 of the second member 38 has a plurality of projections 58 extending downward therefrom. Each of the projections 58 is sized, configured and aligned to be simultaneously inserted into one of the plurality of apertures 32 formed in the first member 14. In FIG. 5, each of the projections 58 is shown as having the same length $l_3$. Alternatively, each of the projections 58 can be made to have a length that is shorter or Longer than the length of at least one of the remaining projections 58.

Figure 7:
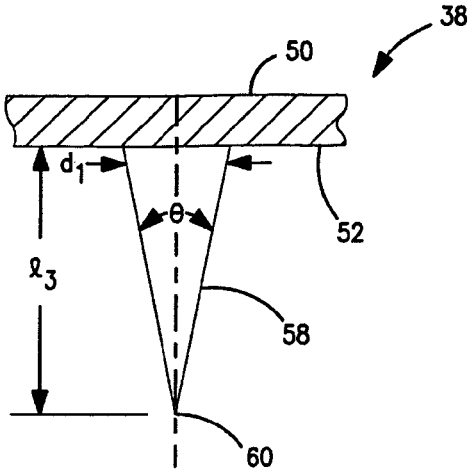
FIG. 7 is a partial cross-sectional view of a projection extending downward from the lower surface of the second member depicting the included angle of the projection.

Referring to FIG. 7, the projection 58 is shown as having a length $l_3$. The length $l_3$ is less than the depth d of each of the apertures 32. For example, if each of the apertures 32 has a depth of about 0.5 inches, then each of the projections 58 will have a length $l_3$ that is less than about 0.5 inches. The length $l_3$ of a projection 58 can range from between about 0.01 inches to about 0.5 inches less than the depth d of the aperture 32 it will engage with. The length $l_3$ of each of the projections 58 can range from between about 0.2 inches to about 0.4 inches. Desirably, the length $l_3$ of each of the projections 58 can range from between about 0.2 inches to about 0.4 inches. More desirably, the length $l_3$ of each of the projections 58 can range from between about 0.25 inches to about 0.4 inches. Even more desirably, the length $l_3$ of each of the projections 58 should be at least about 0.3 inches.

It should be understood that in certain embodiments of the device 10, it may be advantageous that each of the projections 58 do not have the same or a similar length $l_3$. For example, each subsequent row of projections 58, relative to the first side 44, could get shorter or longer in length, if desired.

In FIG. 5, the overall thickness $t_1$ of the second member 38, including the height $h_1$ of the ergonomically sculptured portion 54, is shown. The overall thickness $t_1$ is the distance measured from the top of the ergonomically sculptured portion 54 to the bottom of the plurality of projections 58. The overall thickness $t_1$ can vary. Desirably, the overall thickness $t_1$ will range from between about 0.25 inches to about 4 inches. More desirably, the overall thickness $t_1$ will range from between about 0.3 inches to about 3 inches. Even more desirably, the overall thickness $t_1$ will range from between about 0.5 inches to about 2 inches. As mentioned earlier, the thickness $t_2$ is the smallest or minimum distance between the upper surface 50 and the lower surface 52. This thickness $t_2$ can also vary. Typically, the overall thickness $t_1$ ranges from between about 0.1 inches to 3 inches more than the thickness $t_2$. Desirably, the overall thickness $t_1$ ranges from between about 0.2 inches to 2 inches more than the thickness $t_2$. More desirably, the overall thickness $t_1$ ranges from between about 0.25 inches to 1 inch more than the thickness $t_2$. In some instances the overall thickness $t_1$ can be equal to the thickness $t_2$.

Referring again to FIGS. 5 and 7, each of the projections 58 has a terminal end 60. The terminal end 60 can be flat or angled to a sharp point. A sharp terminal end 60 is desired so as to facilitate penetration of the projections 58 into the sheet of aluminum foil 12. A sharp terminal end 60 makes it much easier to cause each of the projections 58 to penetrate through the thickness of the sheet of aluminum foil 12. The projections 58 can vary in shape. Each of the projections 58 can have an elongated configuration with a constant cross-sectional shape or a non-constant cross-sectional shape. Desirably, each of the projections 58 has a constant diameter. Each of the projections 58 can have a tapered profile or any other profile known to those skilled in the art.

In FIG. 7, a single projection 58 is depicted having a tapered profile o terminating into a sharp point at the terminal end 60. The projection 58 is shown having an included angle theta (θ). The included angle θ can range from between about 20° to about 60°. Desirably, each of the projections 58 can have an included angle θ ranging from between about 25° to about 50°. More desirably, each of the projections 58 can have an included angle θ ranging from between about 25° to about 45°. Even more desirably, each of the projections 58 can have an included angle θ which is at least 30°. An included angle θ constructed to the above identified ranges also facilitates removal of the projections 58 from a perforated sheet of aluminum foil.

Still referring to FIG. 7, the single projection 58 is shown having a maximum cross-sectional dimension $d_1$ of at least about 0.01 inches. Desirably, each of the projections 58 has a maximum cross-sectional dimension $d_1$ of at least about 0.05 inches. More desirably, each of the projections 58 has a maximum cross-sectional dimension $d_1$ of at least about 0.1 inches. Even more desirably, each of the projections 58 has a maximum cross-sectional dimension $d_1$ of from between about 0.01 inches to about 0.2 inches.

Referring again to FIGS. 4-6 and 8, the second member 38 further includes a second guide member 62 which cooperates with the first guide member 34. The second guide member 62 is depicted as four guide receiving segments 64. However, the second guide member 62 can consist of one or more guide receiving segments 64. Desirably, the number of guide receiving segments 64 will correspond to the number of guide segments 36 formed in the first member 14.

In FIGS. 4-6, and 8, each of the four guide receiving segments 64 is depicted as an aperture formed in the second member 38. Two of the guide receiving segments 64 are located adjacent to the first end 40 and the remaining two guide receiving segments 64 are located adjacent to the second end 42. Each of the guide receiving segments 64 is spaced apart from one another. Each of the guide receiving segments 64 extends completely through the second member 38 from the upper surface 50 to the lower surface 52. The guide receiving segments 64 permit the second member 38 to move vertically up and down relative to the first member 14. In other words, the second member 38 can reciprocate relative to the first member 14. The guide receiving segments 64 should be sized sufficiently large relative to the guide segments 36 to permit the second member 38 to move freely up and down relative to the first member 14. The ability of the second member 38 to move vertically relative to the first member 14 allows a sheet of aluminum foil 12, that is placed between the first and second members, 14 and 38 respectively, when they are spaced apart from one another, to be perforated by pressing the second member 38 against the first member 14.

Referring to FIG. 8, a plurality of perforations 66 are shown as having been formed in the sheet of aluminum foil 12 once the second member 38 was pressed downward against the first member 14. It should be understood that alternatively, the first member 14 could be pressed against the second member 38 to form the perforations 66. Still another option is to move or press the first and second members, 14 and 38 respectively, simultaneously against one another to form the plurality of perforations 66.

Referring again to FIGS. 4-6 and 8, each of the four guide receiving segments 64 is sized, configured and aligned to cooperate with one of the first guide segments 36. It should be understood that if only two guide segments 36 are present, then only two guide receiving segments 64 need be present. Desirably, the number of guide receiving segments 64 will correspond to the number of guide segments 36 formed in or secured to the first member 14. The second guide member 62 will be formed in the second member 38 and each guide receiving segment 64 will extend completely through the second member 38 from the upper surface 50 to the lower surface 52. The guide receiving segments or apertures 64 should be aligned perpendicular to the upper surface 50 of the second member 38 so that the guide segments 36 formed in the first member 14 can only move vertically up and down relative to the guide receiving segments 64. This will ensure that the second member 38 can only move vertically relative to the first member 14.

It should be understood that the vertical, sliding fit between the first guide member 34 and the second guide member 62 is a loose fit and that the amount of clearance can be adjusted to suit one's particular needs.

Referring to FIG. 8, one can see that each of the four first guide segments 36 extends above the upper surface 50 of the second member 38 when the first and second members, 14 and 38 respectively, are spaced apart from one another. The distance that each of the four first guide segments 36 extends above the upper surface 50 of the second member 38, when the first and second members, 14 and 38 respectively, are spaced apart from one another, can vary. Desirably, this distance can range from between about 0.1 inches to about 3 inches when the second member 38 is spaced apart from the first member 14 by at least about 1 inch. More desirably, the first guide member 34 will extend above the first surface 16 of the first member 14 by a distance at least equal to the thickness $t_1$ of the second member 38. Even more desirably, the first guide member 34 will extend above the first surface 16 of the first member 14 by a distance equal to at least twice the thickness $t_1$ of the second member 38. Most desirably, the first guide member 34 will extend above the first surface 16 of the first member 14 by a distance equal to at least three times the thickness $t_1$ of the second member 38.

It should be understood that the second member 38 is not connected by any fastener, hinge, etc. to the first member 14. Instead, the first and second members, 14 and 38 respectively, are independent members that are vertically movable one relative to the other by the cooperation of the first and second guide members 34 and 62. This means that the first and second members, 14 and 38 respectively, can be separated from one another when placed in a dishwasher or when cleaned by hand. The first and second members, 14 and 38 respectively, can be stored separately in a kitchen drawer, if desired, although it is advantageous to keep both of the members 14 and 38 together so that one does not misplace one of the members 14 and 38.

Referring again to FIGS. 2 and 5, the first member 14 has a thickness t, not including the height h of the guide member 34. The second member 38 has an overall thickness $t_1$. The thickness t of the first member 14 can be less than, equal to or be greater than the overall thickness $t_1$ of the second member 38. It should be understood that the first guide member 34, which includes the four guide segments 36, extend above the upper surface 50 of the second member 38 when the plurality of projections 58 extend through the plurality of guide receiving segments 64.

Returning to FIG. 8, one can see that depending upon the length of the sheet of aluminum foil 12, one may need to raise and lower (separate and press) the second member 38 against the first member 14 more than one time in order to form the required amount of perforations 66 in the sheet of aluminum foil 12.

It should be understood that the first and second guide members 34 and 62 can be formed or constructed from the same or from a different material as was used to form or construct the first and second members, 14 and 38 respectively. Desirably, the device 10 is constructed from a single material.

Figure 15:
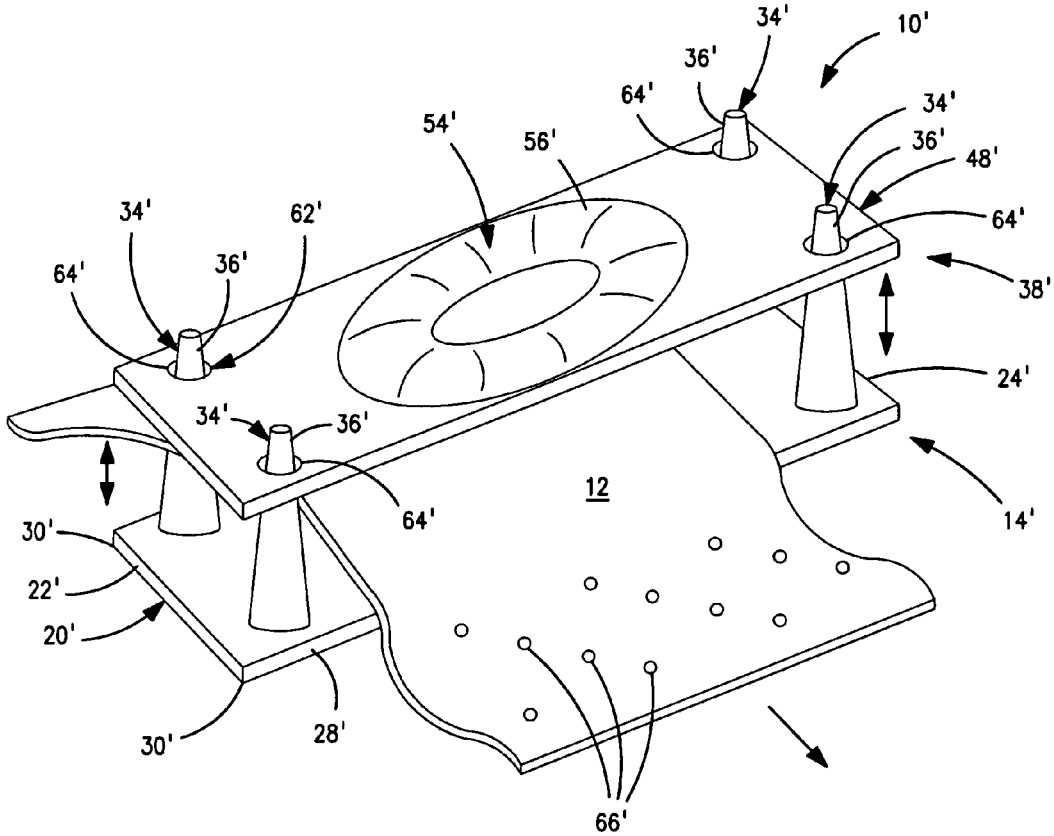
FIG. 15 is a perspective view of the device shown in FIGS. 9-14 depicting a sheet of aluminum foil positioned between the spaced apart first and second members and depicting the leading edge of the sheet of aluminum foil already having been perforated.

Referring now to FIG. 15, another embodiment of a device 10' is shown which is capable of manually perforating a non-perforated sheet of aluminum foil 12.

Referring to FIGS. 9-15, the device 10' can be formed or constructed from the same materials mentioned above with reference to the first device 10. The device 10' includes a first member 14' and a second member 38'. The first member 14' has a length l' and a width w'. The first member 14' has a first surface 16' and an oppositely aligned second surface 18'. The first member 14' also has an outer periphery 20', a first end 22' an oppositely aligned second end 24', a first side 26' and an oppositely aligned second side 28'. The first member 14' also has a thickness t' located between the first and second surfaces, 16' and 18' respectively. The first member 14' further includes a plurality of apertures 32' formed completely through the thickness t'. This is a first difference between the first and second embodiments 10 and 10'.

Figure 9:
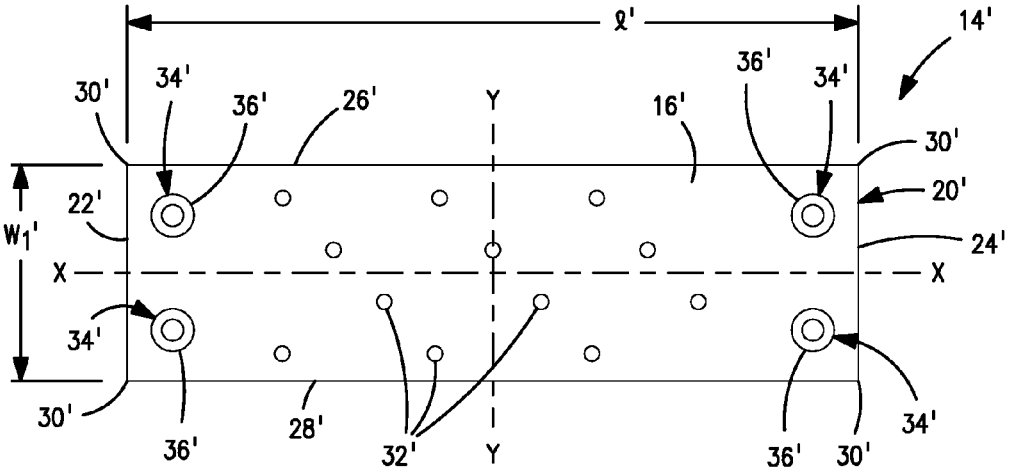
FIG. 9 is a top view of an alternative embodiment showing a first member of a device for manually perforating a sheet of aluminum foil depicting a plurality of apertures formed therein in a pre-selected pattern.
Figure 10:
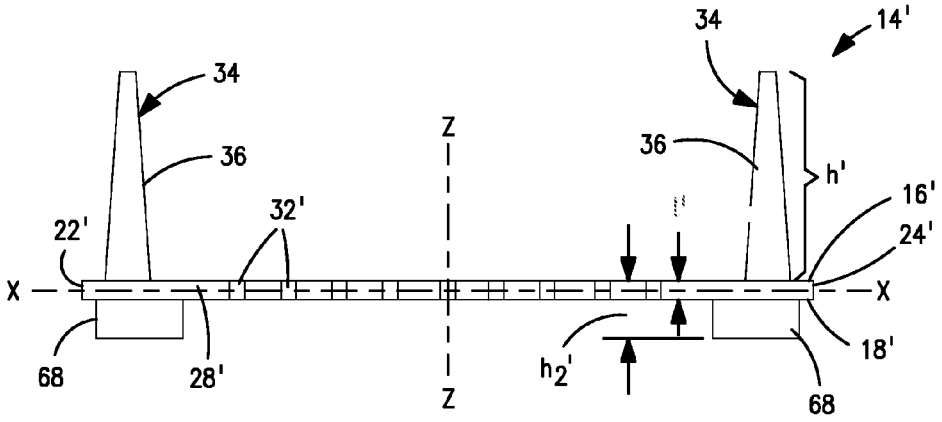
FIG. 10 is a side view of the first member shown in FIG. 9 depicting a first guide member and showing that the plurality of apertures extend completely through the thickness of the first member.

Referring to FIGS. 9 and 10, the first member 14' has a first guide member 34' integrally formed on the first member 14'. The first guide member 34' includes at least two guide segments 36' which extend upward above the first surface 16'. Four guide segments 36' are depicted in FIG. 9. Two of the guide segments 36', 36' are located adjacent to the first end 22' and the remaining two guide segments 36', 36' are located adjacent to the second end 24'.

Figure 11:
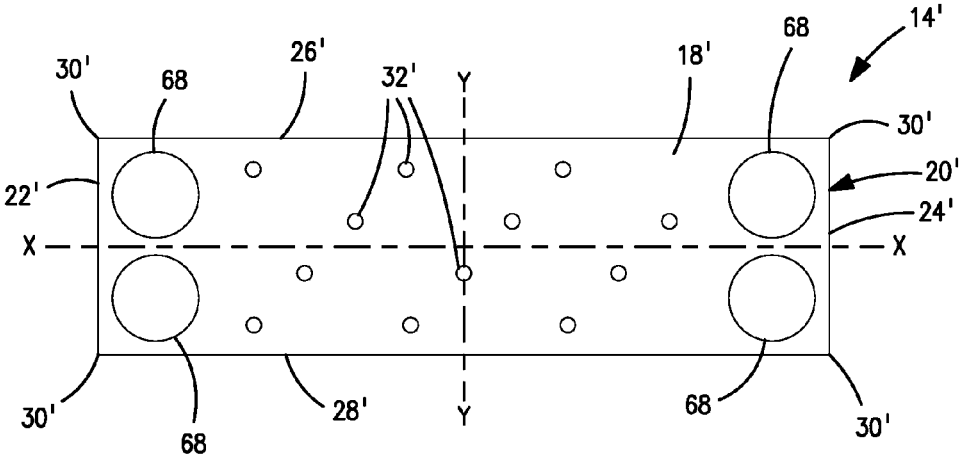
FIG. 11 is a bottom view of the first member shown in FIG. 9 depicting four feet secured approximate at each corner of the first member.
Figure 12:
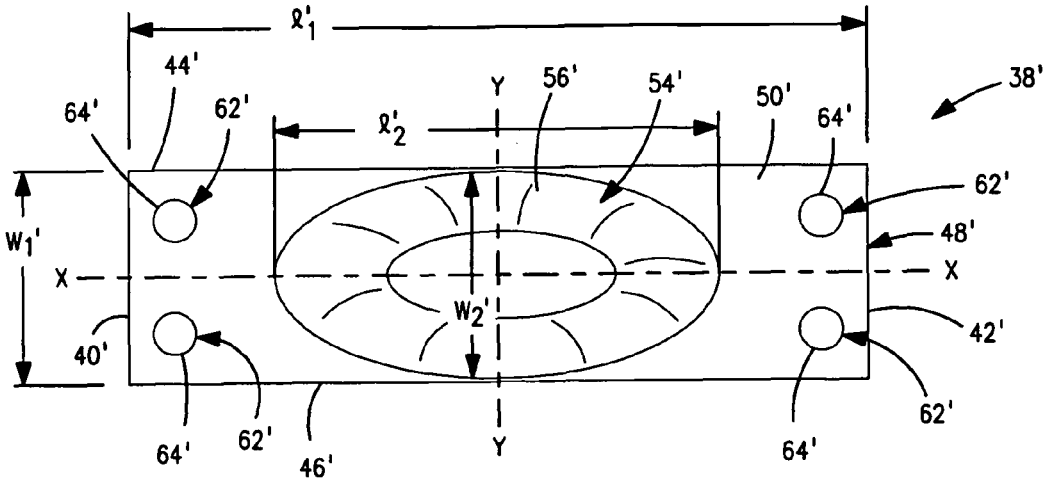
FIG. 12 is a top view of the alternative embodiment showing a second member of a device for manually perforating a sheet of aluminum foil and depicts at least a portion of the upper surface being ergonomically sculptured to fit a human hand.

Referring now to FIGS. 10 and 11, the first member 14' further includes at least two spaced apart feet 68. Four feet 68 are depicted in the drawings. The exact number of feet 68 can vary. Desirably, two or more feet 68 are present. Each foot 68 can be secured, attached or fastened to the second surface 18' of the first member 14'. In FIG. 11, the first member 14' is shaped as a rectangle with four corners 30', 30', 30' and 30'. A foot 68 is present at or adjacent to each of the four corners 30', 30', 30' and 30'. Each foot 68 has a height $h_2'$, see FIG. 10. The height $h_2'$ of each foot 68 can vary from between about 0.1 inches to about 1 inch. Desirably, the height $h_2'$ of each foot 68 can vary from between about 0.15 inches to about 0.5 inches. Even more desirably, the height $h_2'$ of each foot 68 can vary from between about 0.2 inches to about 0.3 inches.

Referring now to FIGS. 12-15, the second member 38' of the device 10' includes an upper surface 50' and a lower surface 52'. The second member 38' has a length $l_1'$ and a width $w_1'$. At least a portion of the upper surface 50' can be ergonomically sculptured at 54' to fit a human hand, see FIGS. 12, 13 and 15. The ergonomically sculptured portion 54' extends between the first and second sides, 44' and 46' respectively, and the ergonomically sculptured portion 54' has a length $l_2'$ and a width $w_2'$. The length $l_2'$ extends over at least 20% of the dimension between the first and second ends, 40' and 42' respectively. In one embodiment, the ergonomically sculptured portion 54' is shaped similar to an optical mouse, commonly used with a computer. The ergonomically sculptured portion 54' can have a convex region 56' which is contoured to allow a person's left hand or right hand to comfortably grasp it. Alternatively, the ergonomically sculptured portion 54' can be contoured such that it will only conform to either the right hand or the left hand. Desirably, the ergonomically sculptured portion 54' is contoured to accept both the right hand and the left hand of a person. The ergonomically sculptured portion 54' can include indentations or cutouts into which the fingers and/or thumb of a person's hand can comfortably fit.

Figure 13:
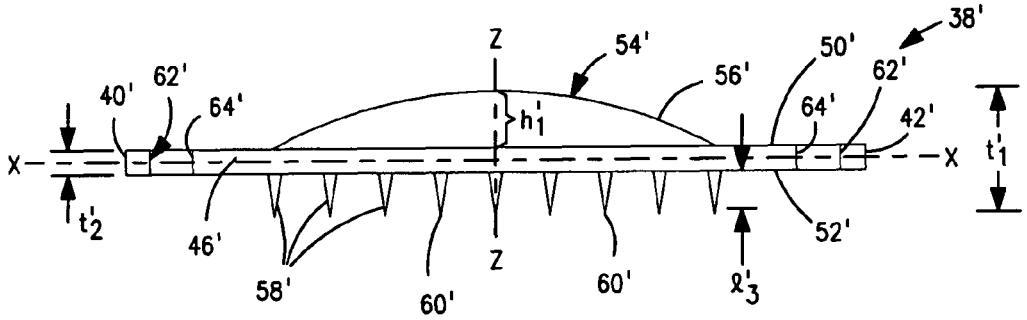
FIG. 13 is a side view of the second member shown in FIG. 12 depicting a plurality of downwardly extending projections.
Figure 14:
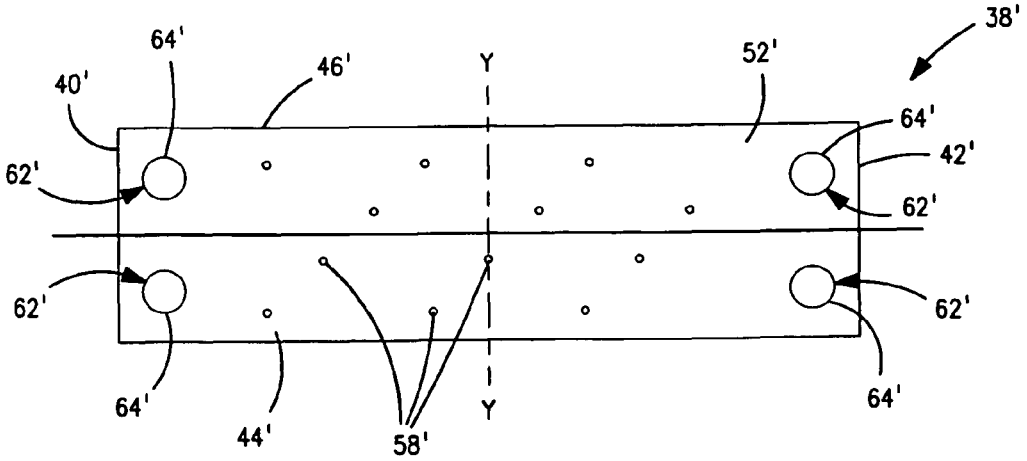
FIG. 14 is a bottom view of the second member shown in FIG. 12 depicting the plurality of downwardly extending projections arranged in a pre-selected pattern.

Referring to FIGS. 13, the lower surface 52' of the second member 38' has a plurality of projections 58' extending downward therefrom. Each of the projections 58' is sized and configured to be simultaneously inserted into and through one of the plurality of apertures 32' formed in the first member 14'. A portion of each of the projections 58' will pass through one of the plurality of apertures 32' formed in the first member 14'. Each of the projections 58' has a length $l_3'$ which is greater than the thickness t' of the first member 14'. For example, if the thickness t' of the first member 14' is about 0.25 inches, then each of the projections 58' will has a length $l_3'$ that is greater than about 0.3 inches. The length $l_3'$ of each of the projections 58' can range from about 0.01 inches to about 0.5 inches greater than the thickness t' of the first member 14'. Desirably, the length $l_3'$ of each of the projections 58' can range from about 0.05 inches to about 0.4 inches greater than the thickness t' of the first member 14'. More desirably, the length $l_3'$ of each of the projections 58' can range from about 0.1 inches to about 0.3 inches greater than the thickness t' of the first member 14'. Even more desirably, the length $l_3'$ of each of the projections 58' should be at least about 0.25 inches greater than the thickness t' of the first member 14'.

It should be noted that each of the projections 58' is shown as having the same or a similar length $l_3'$ in FIG. 13. However, if desired, one or more of the projections 58' can be constructed to have a different length as was explained above with reference to the device 10.

Still referring to FIG. 13, the second member 38' is shown to have an overall thickness $t_1'$ and a thickness $t_2'$. The overall thickness $t_1'$ is the distance from the top of the ergonomically sculptured portion 54' to the bottom of the plurality of projections 58'. The overall thickness $t_1'$ can vary. Desirably, the overall thickness $t_1'$ of the second member 38' will range from between about 0.25 inches to about 4 inches. More desirably, the overall thickness $t_1'$ of the second member 38' will range from between about 0.3 inches to about 3 inches. Even more desirably, the overall thickness $t_1'$ of the second member 38' will range from between about 0.5 inches to about 2 inches. The thickness $t_2'$ is the smallest distance between the upper surface 50' and the lower surface 52'. In some embodiments, the overall thickness $t_1'$ can be equal to the thickness $t_2'$.

Still referring to FIG. 13, each of the plurality of projections 58' has a terminal end 60'. The terminal end 60' of each projection 58' can be flat or sharp. Desirably, each projection 58' is configured to have a terminal end 60' that is a sharp point. When the terminal end 60' of each projection 58' is configured as a sharp point, it facilitates penetration of each of the projections 58' through the thickness of the sheet of aluminum foil 12. The plurality of projections 58' can vary in shape. Each of the projections 58' can have an elongated configuration with a constant or varying cross-sectional profile. Desirably, each projection 58' has a constant cross-sectional diameter. Each projection 58' can also be formed to have a tapered profile or any other profile known to those skilled in the art.

A second significant difference between the device 10 and the device 10' is that each of the feet 68 in the device 10' has a height $h_2$ which when added to the thickness t' of the first member 14' is greater than the length $l_3'$ of each of the plurality of projections 58'. This will assure that the terminal ends 60' of the projections 58' do not scrap or contact an underlying surface, such as the top surface of a counter. Desirably, the length $l_3'$ of each of the plurality of projections 58' is less than about 0.2 inches of the combined dimension of the height $h_2$ of a foot 68 plus the thickness t' of the first member 14'.

Referring again to FIG. 15, one can see that depending upon the length of the sheet of aluminum foil 12, one may need to raise and lower (separate and press) the second member 38' against the first member 14' more than one time to form the required amount of perforations 66' in the sheet of aluminum foil 12.

Figure 16:
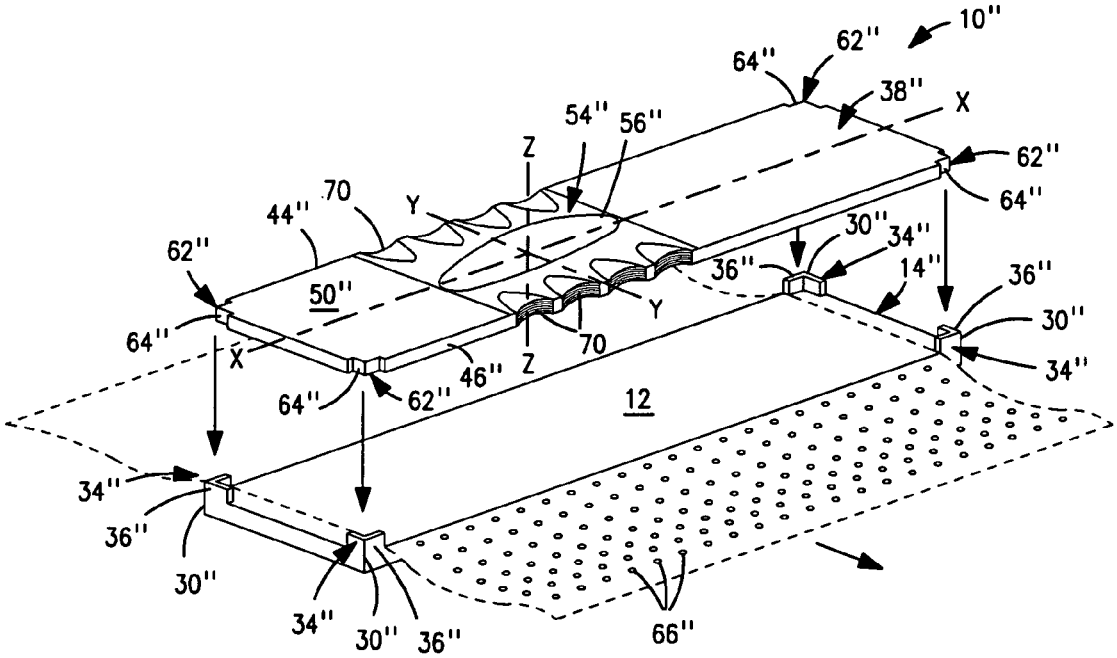
FIG. 16 is a perspective view of another embodiment of a device for manually perforating a sheet of aluminum foil and depicts a different ergonomically sculptured upper surface on the second member and differently configured first and second guide members located at each corner of the first and second members.

Referring now to FIG. 16, a third embodiment of a device 10" is shown which is capable of manually perforating a non-perforated sheet of aluminum foil 12. The device 10" can be formed or constructed from the same materials mentioned above with reference to the device 10 or 10'. The device 10" is similar to the device 10 except that the first member 14" has a first guide member 34" in the form of four L-shaped guide segments 36. Each L-shaped guide segment 36" is located at one of the four corners 30", 30", 30" and 30". Each of the L-shaped guide segments 36" is sized, configured, aligned and designed to mate or cooperate with one of the second guide members 62" formed on the second member 38". The second guide member 62" includes four guide receiving segments 64". Each of the four guide receiving segments 64" is notched to slideably fit in one of the L-shaped guide segments 36".

It should be understood that various other geometries can be utilized for the guide segments 36" and the cooperating guide receiving segments 64".

The device 10" also differs from the device 10 in that the ergonomically sculptured portion 54" is slightly different in profile and configuration. It still has a convex region 56" but this region is flatter in design. The ergonomically sculptured portion 54" also contains a number of finger and/or thumb indentations or cutouts 70 formed in the first and second sides, 44" and 46" respectively. Four cutouts 70 are depicted as being present in each of the first and second sides, 44" and 46" respectively. The number of indentations or cutouts 70 formed in each of the first and second sides, 44" and 46" respectively, can vary. For example, a single indentation or cutout 70 can be formed in each of the first and second sides, 44' and 46' respectively. One of the indentations or cutouts 70 can receive a finger while the second indentation or cutout 70 can receive a thumb.

The size, shape and location of each of the indentations or cutouts 70 can also vary. All the indentations or cutouts do not have to be of the same size and/or shape. Desirably, each of the indentations or cutouts 70 has a concave configuration when viewed from the upper surface 50" of the second member 38". One of the indentations or cutouts 70 can be shaped and sized to receive a human thumb, if desired. A thumb receiving indentation or cutout can be larger in size than a finger receiving indentations or cutouts. Desirably, four fingers of the user's hand will fit into the indentations or cutouts 70 located on one side of the device 10" and the person's thumb will fit into one of the indentations or cutouts 70 located on the opposite side of the device 10". This will enable the user to firmly grasp the second member 38" and press it against the first member 14". The indentations or cutouts 70 will also allow the user to raise the second member 38" relative to the first member 14" so as to advance the sheet of aluminum foil 12 and again press the second member 38" against the first member 14" so that additional perforations 66 can be formed in the sheet of aluminum foil 12.

Figure 17:
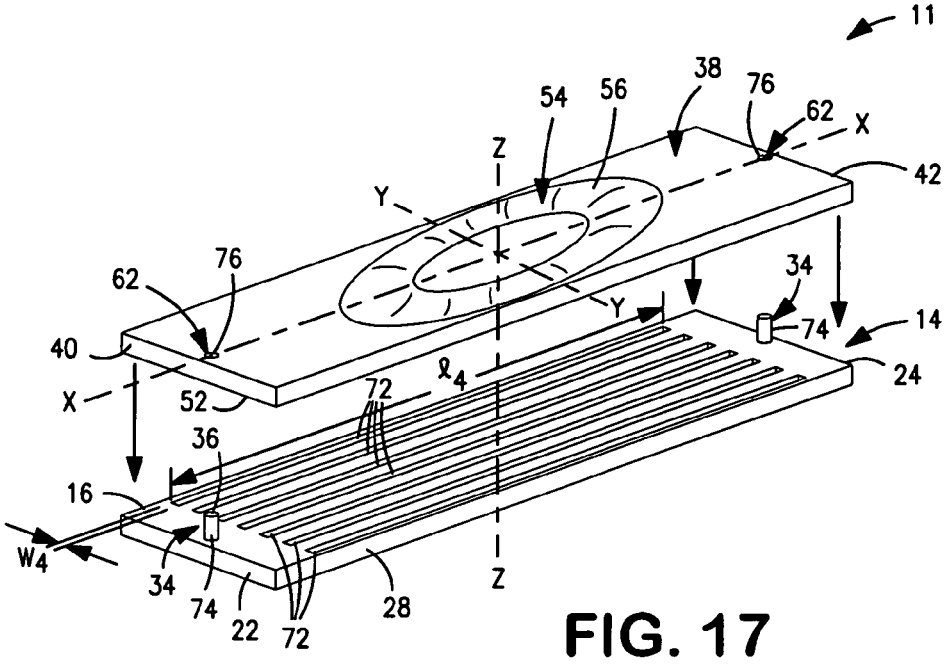
FIG. 17 is a perspective view of still another embodiment of a device for manually perforating a sheet of aluminum foil and depicts several grooves formed in the first member which are aligned parallel to the longitudinal central axis X-X.

Referring to FIG. 17, a fourth embodiment of a device 11 is shown which is capable of manually perforating a non-perforated sheet of aluminum foil 12. The device 11 can be formed or constructed from the same materials mentioned above with reference to the device 10, 10' or 10". The device 11 is similar to the device 10 except that the first member 14 includes a plurality of grooves 72 in place of a plurality of apertures 32. Seven elongated grooves 72 are depicted in FIG. 17 and each groove 72 is aligned parallel to the longitudinal central axis X-X. However, the number of grooves 72 can vary from one to twenty. Desirably, at least three grooves 72 are present. More desirably, at least four grooves 72 are present. Even more desirably, at least five grooves 72 are present. Most desirably, at least six grooves 72 are present. Each groove 72 can be spaced apart from an adjacent groove 72.

The length, width and depth of each of the grooves 72 can vary. For example, each of the grooves 72 has a length $l_4$ measured parallel to the longitudinal central axis X-X. Each groove 72 can have a length $l_4$ of at least six inches. Each groove 72 also has a width $w_4$ measured parallel to the transverse central axis Y-Y of at least 0.1 inches, and a depth (not shown) measured parallel to the vertical central axis Z-Z of at least 0.1 inches. Each of the grooves 72 extends parallel to the first and second sides 26 and 28. Alternatively, each of the grooves 72 can extend at an acute angle to the longitudinal central axis X-X. Each of the grooves 72 is formed in the first surface 16 of the first member 14. The depth and shape of each groove 72 can vary. In addition, all of the grooves 72 do not have to be identical in size, profile and/or configuration. Desirably, each of the grooves 72 is identical in size and appearance and each is spaced approximately the same distance apart from an adjacent groove 72. Alternatively, the grooves 72 can be spaced at varying distances apart from one another.

Since each of the grooves 72 is elongated in appearance, each of the grooves 72 should be capable of receiving at least three of the projections 58 (not shown) which extend downward from the second member 38. Desirably, each of the grooves 72 should be capable of receiving at least five of the projections 58 which extend downward from the second member 38. More desirably, each of the grooves 72 should be capable of receiving at least seven of the projections 58 which extend downward from the second member 38. Even more desirably, each of the grooves 72 should be capable of receiving at least ten of the projections 58 which extend downward from the second member 38.

The device 11 also differs from the device 10 in that the first guide member 34 includes a pair of upstanding posts 74, 74 each located adjacent to one of the first and second ends, 22 and 24 respectively, of the first member 14. The second guide member 62 includes a pair of apertures 76 each located adjacent to one of the first and second ends, 40 and 42 respectively, of the second member 38. Each of the apertures 76, 76 is sized, configured and aligned to receive one of the pair of posts 74, 74. Each of the apertures 76, 76 extend completely through the second member 38 whereby the pair of upstanding posts 74, 74 can easily slide within the pair of apertures 76, 76. The pair of posts 74, 74 have a sufficient height to enable them to engage or mate with the pair of apertures 76, 76 even when the lower surface 52 of the second member 38 is raised about 1 inch above the first surface 16 of the first member 14.

Figure 18:
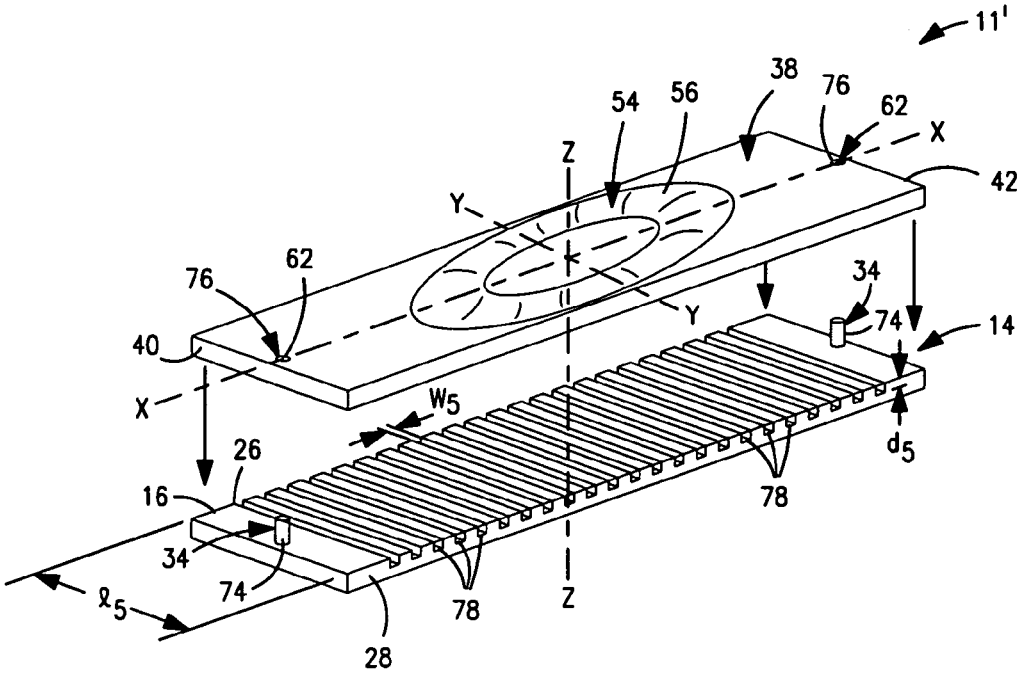
FIG. 18 is a perspective view of a further embodiment of a device for manually perforating a sheet of aluminum foil and depicts several grooves formed in the first member which are aligned parallel to the transverse central axis Y-Y.

Referring to FIG. 18, a fifth embodiment of a device 11' is shown which is capable of manually perforating a non-perforated sheet of aluminum foil 12. The device 11' can be formed or constructed from the same materials mentioned above with reference to the device 10, 10', 10" or 11. The device 11' is similar to the device 11 except that a plurality of grooves 78 is formed in the first surface 16 of the first member 14 such that each groove 78 is aligned parallel to the transverse central axis Y-Y. In other words, the grooves 78 extend perpendicular to the first and second sides, 26 and 28 respectively, of the first member 14. Alternatively, the grooves 78 can be aligned at an acute angle to the transverse central axis Y-Y. Over twenty grooves 78 are depicted as being formed in the first member 14. The exact number of the grooves 78 that are present can vary. Desirably, at least ten of the grooves 78 are present. More desirably, at least fifteen of the grooves 78 are present. Even more desirably, at least twenty of the grooves 78 are present. Most desirably, more than twenty of the grooves 78 are present.

Each groove 78 has a length $l_5$, a width $w_5$ and a depth $d_5$. The length $l_5$, width $w_5$ and depth $d_5$ of each of the grooves 78 can vary. The length $l_5$ of each of the grooves 78 is measured parallel to the transverse central axis Y-Y. The length $l_5$ can be less than or equal to the width w of the first member 14. The width $w_5$ of each of the grooves 78 is measured parallel to the longitudinal central axis X-X. The width $w_5$ can also vary. The width $w_5$ should be at least about 0.1 inches. The depth $d_5$ of each of the grooves 78 is measured parallel to the vertical central axis Z-Z. The depth $d_5$ can also vary. The depth $d_5$ of each of the grooves 78, should be at least about 0.1 inches.

Since each of the grooves 78 is elongated in appearance, each of the grooves 78 should be capable of receiving at least three of the projections 58 which extend downward from the second member 38. Desirably, each of the grooves 78 should be capable of receiving at least four of the projections 58 which extend downward from the second member 38. More desirably, each of the grooves 78 should be capable of receiving at least five of the projections 58 which extend downward from the second member 38. Even more desirably, each of the grooves 78 should be capable of receiving at least seven of the projections 58 which extend downward from the second member 38.

Figure 19:
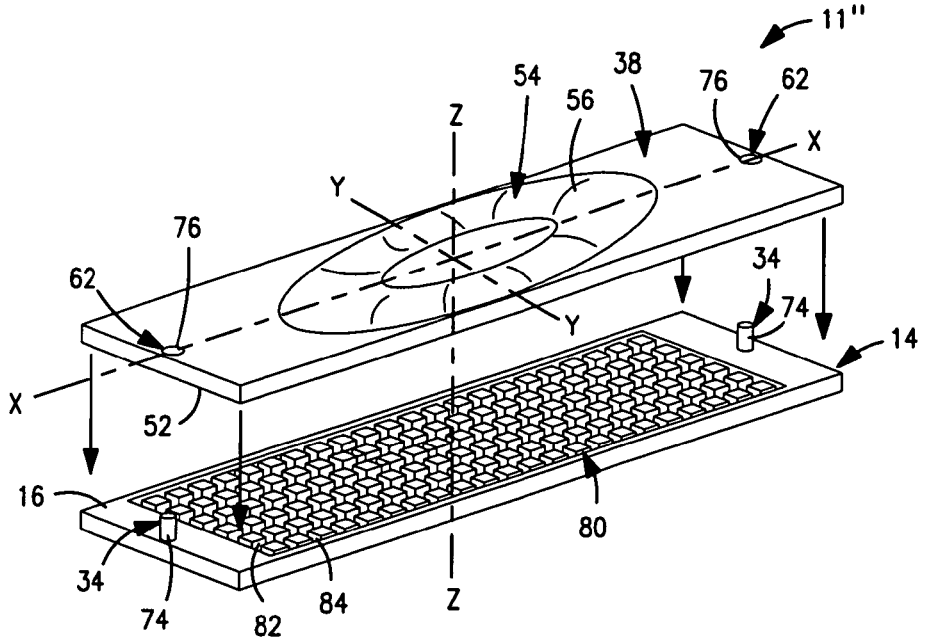
FIG. 19 is a perspective view of a still further embodiment of a device for manually perforating a sheet of aluminum foil and depicts a waffle pattern of grooves formed in the first member.

Referring to FIG. 19, a sixth embodiment of a device 11" is shown which is capable of manually perforating a non-perforated sheet of aluminum foil 12. The device 11" can be formed or constructed from the same materials mentioned above with reference to the device 10, 10', 10", 11 or 11'. The device 11" differs from the previous devices 10, 10', 10", 11 and 11' in that a waffle pattern 80 is formed in the first member 14. The waffle pattern 80 includes a plurality of first grooves 82 and a plurality of second grooves 84. The first and second grooves, 82 and 84 respectively, are aligned perpendicular to one another. Alternatively, the first and second grooves, 82 and 84 respectively, could be formed at an acute angle to one another. The first grooves 82 are contacted by and/or intersected by each of the second grooves 84 to form a waffle pattern 80. The projections 58 (not shown), which are formed on the lower surface 52 of the second member 38, will engage with the first and second grooves, 82 and 84 respectively. It should be understood that more than one of the projections 58 can engage with a single one of the first grooves 82. Likewise, more than one of the projections 58 can engage with a single one of the second grooves 84. The first and second grooves, 82 and 84 respectively, extend downward from the first surface 16 of the first member 14. The depths of the first and second grooves, 82 and 84 respectively, can vary. Desirably, the first and second grooves, 82 and 84 respectively, are constructed to the same depth. More desirably, the depth of the first and second grooves, 82 and 84 respectively, will be at least about 0.1 inches. Even more desirably, the depth of the first and second grooves, 82 and 84 respectively, will be at least about 0.25 inches.

Figure 20:
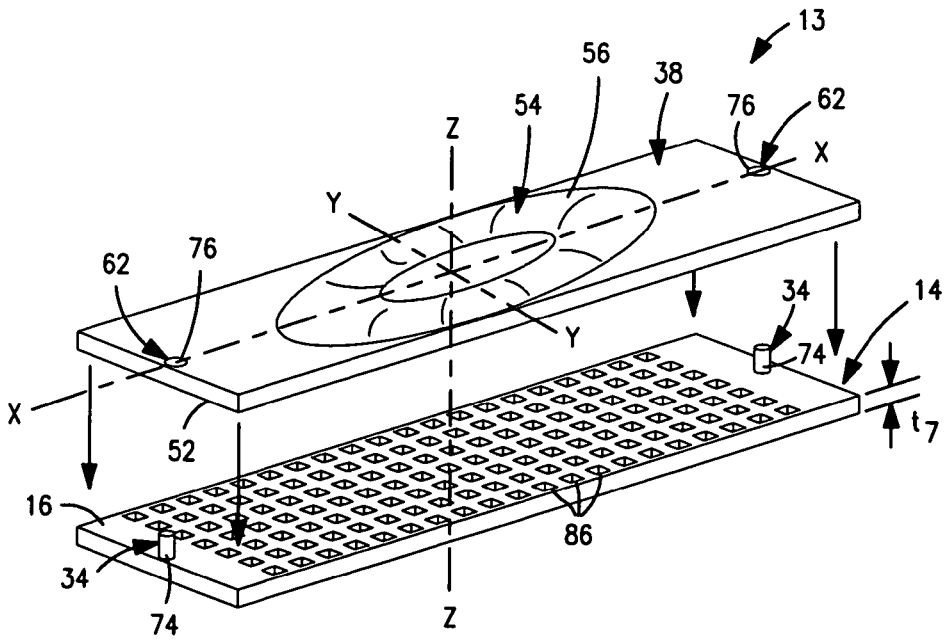
FIG. 20 is a perspective view of a still another embodiment of a device for manually perforating a sheet of aluminum foil and depicts a plurality of square shaped apertures formed in the first member.

Referring to FIG. 20, a seventh embodiment of a device 13 is shown which is capable of manually perforating a non-perforated sheet of aluminum foil 12. The device 13 can be formed or constructed from the same materials mentioned above with reference to the device 10, 10', 10", 11, 11' or 11". The device 13 differs from the device 11" in that it has a plurality of spaced apart, square apertures 86 formed in the first surface 16 of the first member 14. The plurality of square apertures 86 can extend partly or completely through the thickness $t_7$ of the first member 14. Each of the plurality of square apertures 86 is sized to engage with one or more of the plurality of projections 58 (not shown) which extend downward from the lower surface 52 of the second member 38.

It should be understood that the plurality of projections 58 extending downward from the second member 38 do not have to have a square cross-section but do need to be sized to fit within one of the plurality of square apertures 86.

Figure 21:
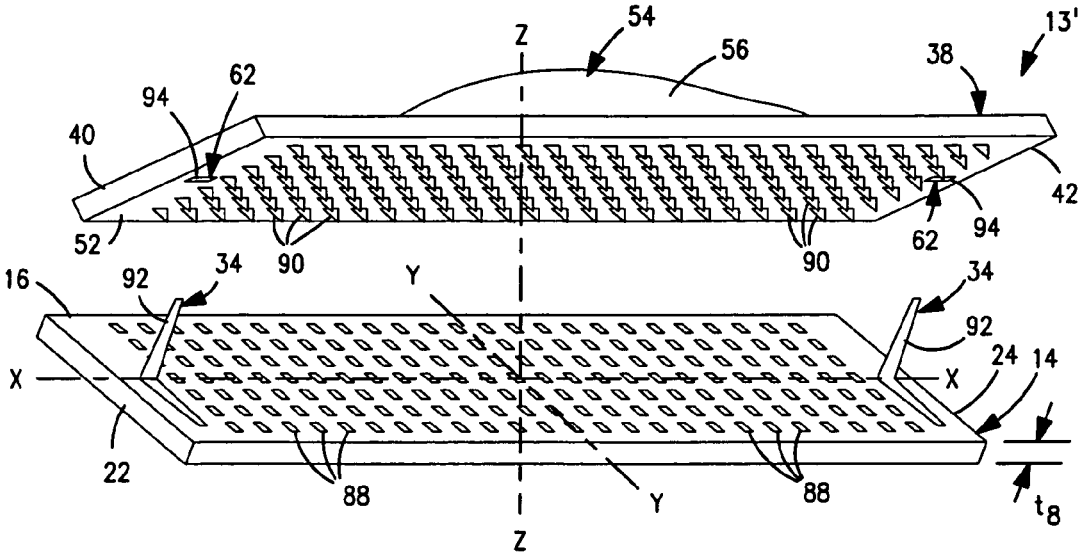
FIG. 21 is a perspective view of a still another embodiment of a device for manually perforating a sheet of aluminum foil and depicts a first guide member integrally formed from the first member and a plurality of projections which are integrally formed from the second member.
Figure 22:
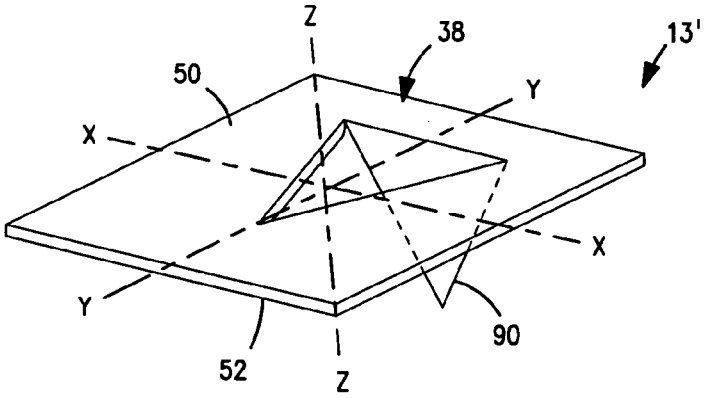
FIG. 22 is an enlarged view of a portion of the second member shown in FIG. 21 and depicts how each projection is integrally formed therefrom.

Referring now to FIGS. 21 and 22, an eighth embodiment of a device 13' is shown which is capable of manually perforating a non-perforated sheet of aluminum foil 12. The device 13' can be formed or constructed from the same materials mentioned above with reference to the device 10, 10', 10", 11, 11', 11" or 13. The device 13' is different from the previously mentioned devices 10, 10', 10", 11, 11', 11" and 13 in that the first member 14 has a plurality of apertures 88 formed therein which are configured as narrow slots. The plurality of apertures 88, i.e. the narrow slots, can extend partly or completely through the thickness $t_8$ of the first member 14. The plurality of apertures 88 could be replaced by any other known geometrical design, if desired. The plurality of apertures 88 can be arranged in any desired geometrical pattern.

The device 13' also includes a plurality of projections 90 formed in the second member 38 which extend downward from the lower surface 52. Each of the plurality of projections 90 is sized, configured and arranged to engage with one of the apertures 88. Each of the projections 90 is integrally formed from the second member 38. For example, each of the projections 90 can be punched, cut or stamped out of the second member 38.

Referring to FIG. 22, a single projection 90 is depicted which is punched, cut or stamped out from a portion of the second member 38 such that a portion of the projection 90 remains attached to the second member 38. It should be noted that the ergonomically sculptured portion 54 can be secured or affixed to the upper surface 50 of the second member 38 after the plurality of projections 90 are formed. As discussed above with reference to the other embodiments, the number of projections 90, the individual design of each projection 90, and the depth of each of the projections 90, etc. can vary. It is anticipated that each of the projections 90 will match up and cooperate with one of the plurality of apertures 88.

Referring again to FIG. 21, the device 13' also has a first guide member 34 integrally formed from the first member 14.

The first guide member 34 is in the form of a pair of narrow pins 92, 92 that are punched, stamped out or otherwise formed from the first member 14. One of the pair of narrow pins 92 is located adjacent to the first end 22 of the first member 14 and the other of the pair of narrow pins 92 is located adjacent to the second end 24 of the first member 14. Each of the pair of narrow pins 92, 92 can vary in height. Each of the pair of narrow pins 92, 92 is bent or configured to be aligned at approximately a 90 degree angle to the first surface 16. It should be understood that other angles could also be utilized.

The second member 38 of the device 13' has a second guide member 62 in the form of a pair of narrow slots 94, 94. One of the pair of narrow slots 94, 94 is located adjacent to the first end 40 of the second member 38 and the other slot 94 is located adjacent to the second end 42 of the second member 38. The pair of narrow slots 94, 94 are sized, configured and aligned to mate with and cooperate with the pair of narrow pins 92, 92. Each of the pair of narrow slots 94, 94 extends completely through the thickness of the second member 38. A unique feature of the device 13' is that the plurality of apertures 88, the plurality of projections 90, and the first and second guide members 34 and 62 respectively, are all integrally formed from the first or second members, 14 or 38 respectively. This design reduced manufacturing expenses and eliminates individual parts and/or components that need to be attached or secured to one another such as by welding, by mechanical fasteners, by an adhesive, glue, etc.

Still referring to FIG. 21, one will notice that the plurality of apertures 88 are aligned perpendicular to the longitudinal central axis X-X. However, the plurality of apertures 88 could be aligned parallel to the longitudinal central axis X-X or be aligned at an acute angle to the longitudinal central axis X-X. It is also possible to vary the orientation of the plurality of projections 90 such that they do not all align with one another, if desired.

Method

Referring to FIG. 23, a flow chart is shown which depicts a method of manually perforating a sheet of aluminum foil 12. The method includes the steps of placing a non-perforated sheet of aluminum foil 12 between a first surface 16 of a first member 14 and lower surface 52 of a second member 38. The first surface 16 has a plurality of apertures 32 formed therein. The second member 38 has an upper surface 50 and at least a portion of the upper surface 50 is ergonomically sculptured to fit a human hand. The lower surface 52 of the second member 38 has a plurality of projections 58 extending downwardly therefrom. Each of the projections 58 is sized and configured to be simultaneously inserted into one of the plurality of apertures 32. Each of the plurality of projections 58 has a sharp terminal end 60. A first guide member 34 is formed on the first member 14 and a second guide member 62 is formed on the second member 38. The second guide member 38 is sized and configured to cooperate with the first guide member 34 to permit the second member 38 to move vertically up and down relative to the first member 14. The method also includes the step of manually pressing the second member 38 against the first member 14 to cause the plurality of projections 58 to penetrate through the sheet of aluminum foil 12 and form a plurality of perforations 66 therein. The method further includes the step of moving the lower surface 50 of the second member 38 vertically away from the first surface 16 of the first member 14 such that the plurality of projections 58 are spaced apart from the first surface 16 and from the perforated sheet of aluminum foil. Lastly, the method includes the step of removing the perforated sheet of aluminum foil from between the first and second members, 14 and 38 respectively.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A device for manually perforating a sheet of aluminum foil, comprising:

a) a first member having a first surface and an oppositely aligned second surface with a thickness therebetween, said first surface having a plurality of apertures formed therein, and each of said plurality of apertures having a depth which is equal to said thickness to said first member;

b) first and second guide posts formed on said first member which extend upwardly above said first surface;

c) a second member having an upper surface and a lower surface, a first side and a second side, at least a portion of said upper surface of said second member having an ergonomically sculptured portion having a length and a width, and sized to fit a human hand and including a convex region which extends from said first side to said second side and which is contoured to allow either a person's left or right hand to grasp said ergonomically sculptured portion and manually press said second member downward toward said first member, said ergonomically sculptured portion being generally oval, having its widest portion where it connects to said second member, and covering about 47% of said upper surface, and said lower surface of said second member having a plurality of projections extending downwardly therefrom, each of said plurality of projections being sized and configured to be simultaneously inserted into one of said plurality of apertures, and each of said projections having a length which is greater than said depth of each of said plurality of apertures, and each of said projections having a sharp terminal end;

d) first and second guide holes formed in said second member which are sized and configured to cooperate with said first and second guide posts, said first and second guide posts having no fasteners thus permitting said second member to move vertically relative to said first member and to be separated from said first member when being cleaned, whereby a sheet of aluminum foil placed between said first and second members, when they are spaced apart from one another, can be perforated by pressing said second member against said first member; and e) four spaced apart feet secured to said second surface of said first member.

2. The device of claim 1 wherein said first member has a first end and a second end and each of said first and second guide posts is located adjacent to one of said first and second ends of said first member, said second member has a first end and a second end and each of said first and second guide holes is located adjacent to one of said first and second ends of said second member, and each of said first and second guide holes is sized, configured and aligned to receive one of said first and second guide posts, and each of said first and second guide holes extends completely through said second member whereby said first and second guide posts can cooperate with said first and second guide holes even when said lower surface of said second member is raised about 1 inch above said first surface of said first member.

3. The device of claim 1 wherein each of said projections is tapered at an included angle ranging from between about 25° to about 60° , each of said projections has a cross-sectional dimension of at least about 0.1 inches, and all of said projections have the same length.

4. The device of claim 1 wherein said first member s shaped as a rectangle with four corners, a foot is present at each of said corners, and each foot has a height ranging from between about 0.1 inches to about 0.5 inches.

5. The device of claim 1 wherein said device is dishwasher safe.

6. The device of claim 1 wherein said device is stainless steel.

7. The device of claim 1 wherein said device is plastic.

8. The device of claim 1 wherein said device is aluminum.

9. The device of claim 1 wherein said device is chrome plated.

10. The device of claim 1 wherein each of said at least two spaced apart feet has a height, and when this height is added to said thickness of said first member it is greater than said length of each of said plurality of projections.

11. The device of claim 1 wherein said device metal.

12. A device for manually perforating a sheet of aluminum foil, comprising:

a) a first member having a first surface and an oppositely aligned second surface with a thickness therebetween, said first member having an outer periphery, said first surface having a plurality of apertures formed therein, and each of said plurality of apertures extending completely through said thickness to said first member;

b) first and second guide posts integrally formed on said first member which extend upwardly above said first surface;

c) a second member having an upper surface and a lower surface, a first side and a second side, an outer periphery which is contiguous with said outer periphery of said first member, at least a portion of said upper surface of said second member having an ergonomically sculptured portion having a length and a width, and sized to fit a human hand and including a convex region which extends from said first side to said second side and which is contoured to allow either a person's left or right hand to grasp said ergonomically sculptured portion and manually press said second member downward toward said first member, said ergonomically sculptured portion being generally oval, having its widest portion where it connects to said second member and covering about 47% of said upper surface, and said lower surface of said second member having a plurality of projections extending downwardly therefrom, said second member having a periphery contiguous with said periphery of said first member, each of said plurality of projections being sized and configured to simultaneously be inserted into one of said plurality of apertures, each of said plurality of projections having a length greater than said thickness of said first member, and each of said plurality of projections having a sharp terminal end;

d) first and second guide holes formed in said second member which are sized and configured to cooperate with said first and second guide posts, said first and second posts having no fasteners thus permitting said second member to move vertically relative to said first member and to be separated from said first member when being cleaned, whereby a sheet of aluminum foil placed between said first and second members, when they are spaced apart from one another, can be perforated by pressing said second member against said first member; and e) four spaced apart feet secured to said second surface of said first member.

13. The device of claim 12 wherein said ergonomically sculptured portion has a convex region which is contoured to allow a person's left hand or right hand to comfortably grasp it.

14. The device of claim 12 wherein said device is dishwasher safe.

15. The device of claim 12 wherein each of said four spaced apart feet has a height, and when this height is added to said thickness of said first member it is greater than said length of each of said plurality of projections.

16. A device for manually perforating a sheet of aluminum foil, comprising:

a) a first member having a first surface and an oppositely aligned second surface with a thickness therebetween, said first member having a plurality of apertures formed therein, and each of said plurality of apertures having a depth which is equal to said thickness to said first member, and said first member having an outer periphery;

b) first and second guide posts formed on said first member which extend upwardly above said first surface;

c) a second member having an upper surface and a lower surface, a first side and a second side, an outer periphery which is contiguous with said outer periphery of said first member, at least a portion of said upper surface of said second member having an ergonomically sculptured portion having a length and a width, and sized to fit a human hand and including a convex region which extends from said first side to said second side and which is contoured to allow either a person's left or right hand to grasp said ergonomically sculptured portion and manually press said second member downward toward said first member, said ergonomically sculptured portion being generally oval, having its widest portion where it connects to said second member, and covering about 47% of said upper surface, and said lower surface having a plurality of projections extending downwardly therefrom, each of said plurality of projections being sized and configured to be simultaneously inserted into one of said plurality of apertures, and each of said projections having a length which is greater than said depth of each of said plurality of apertures, and each of said projections having a sharp terminal end;

d) first and second guide holes formed in said second member which are sized and configured to cooperate with said first and second guide posts, said first and second guide posts having no fasteners thus permitting said second member to move vertically relative to said first member and to be separated from said first member when being cleaned, whereby a sheet of aluminum foil placed between said first and second members, when they are spaced apart from one another, can be perforated by pressing said second member against said first member; and e) at least two spaced apart feet secured to said second surface of said first member.

17. The device of claim 16 wherein each of said at least two spaced apart feet has a height, and when said height is added to said thickness of said first member the total is greater than said length of each of said plurality of projections.

18. The device of claim 16 wherein said device is ferrous metal.

* * * * *

UNITED STATES PATENT AND TRADEMARK OFFICE

CERTIFICATE OF CORRECTION

PATENT NO. : 8,661,958 B2
APPLICATION NO. : 13/313575
DATED : March 4, 2014
INVENTOR(S) : Michael Arthur Chizek It is certified that error appears in the above-identified patent and that said Letters Patent is hereby corrected as shown below:

In the Specification

In column 4, line 20, remove “a” between “of” and “still”.
In column 5, line 14, remove “resistance” and insert --resistant--.
In column 7, line 49, insert --of-- after “75%”.
In column 7, line 52, insert --of-- after “80%”.
In column 8, line 35, remove “Longer” and insert --longer--.
In column 9, line 25, remove “o” between “profile” and “terminating”.
In column 12, line 32, remove “has” and insert --have--.

In the Claims

In Claim 3, column 19, line 6, remove the extra space between “60°” and the “,”.
In Claim 4, column 19, line 9, remove “s” and insert --is--.
In Claim 12, column 19, line 50, insert a --,-- after “second member”.

Signed and Sealed this
Seventeenth Day of June, 2014

Michelle K. Lee

Michelle K. Lee
*Deputy Director of the United States Patent and Trademark Office*